US007293604B2

(12) United States Patent
Sasaki et al.

(10) Patent No.: US 7,293,604 B2
(45) Date of Patent: Nov. 13, 2007

(54) HEAT EXCHANGER

(75) Inventors: Yoshihiro Sasaki, Sano (JP); Takashi Fujita, Sano (JP)

(73) Assignee: Calsonic Kansei Corporation (JP)

( * ) Notice: Subject to any disclaimer, the term of this patent is extended or adjusted under 35 U.S.C. 154(b) by 498 days.

(21) Appl. No.: 10/777,821

(22) Filed: Feb. 12, 2004

(65) Prior Publication Data

US 2004/0194938 A1 Oct. 7, 2004

(30) Foreign Application Priority Data

Feb. 13, 2003 (JP) ..... P 2003-035689

(51) Int. Cl.
*F28D 7/00* (2006.01)

(52) U.S. Cl. ..... 165/165; 165/176; 165/164

(58) Field of Classification Search ..... None
See application file for complete search history.

(56) References Cited

U.S. PATENT DOCUMENTS

| | | | | |
|---|---|---|---|---|
| 2,003,122 | A * | 5/1935 | Schwarz | 165/62 |
| 2,879,050 | A * | 3/1959 | Folger | 165/81 |
| 3,414,052 | A * | 12/1968 | Chojnowski et al. | 165/164 |
| 4,011,905 | A | 3/1977 | Millard | |
| 5,137,082 | A | 8/1992 | Shimoya et al. | |
| 5,314,013 | A * | 5/1994 | Tanabe | 165/176 |
| 5,875,837 | A * | 3/1999 | Hughes | 165/140 |
| 6,315,037 | B1 * | 11/2001 | Haussmann | 165/174 |
| 6,540,015 | B1 * | 4/2003 | Kawachi et al. | 165/164 |
| 6,892,803 | B2 * | 5/2005 | Memory et al. | 165/165 |
| 6,959,758 | B2 * | 11/2005 | Hughes et al. | 165/165 |
| 2004/0104018 | A1 * | 6/2004 | Hughes et al. | 165/164 |

FOREIGN PATENT DOCUMENTS

| | | | |
|---|---|---|---|
| DE | 39 09 465 | A1 | 10/1990 |
| DE | 198 30 846 | A1 | 1/2000 |
| DE | 198 36 889 | A1 | 2/2000 |
| DE | 100 45 175 | A1 | 5/2001 |
| FR | 588292 | A | 5/1925 |
| GB | 971334 | A | 9/1964 |
| JP | 10170175 | | 6/1998 |
| JP | 2001-174083 | A | 6/2001 |

* cited by examiner

*Primary Examiner*—Allen J. Flanigan
(74) *Attorney, Agent, or Firm*—Kilpatrick Stockton LLP

(57) ABSTRACT

A heat exchanger is disclosed including a first tube, a second tube, a first inlet-connecting block, a first outlet-connecting block, a second inlet-connecting block, a second outlet-connecting block and a terminal connecting block. The first tube internally has a first flow passage through which first coolant flows. The second tube internally has a second flow passage through which second coolant flows. The first tube is connected to the first inlet-connecting block and the first outlet-connecting block. The second tube is classified into an inflow tube group and an outflow tube group. Tubes that belong to the inflow tube group are connected to the second inlet-connecting block and the terminal connecting block. Tubes that belong to the outflow tube group are connected to and the terminal connecting block and the second outlet-connecting block. The first and second tubes are disposed such that the first and second flow passages are substantially perpendicular to one another.

2 Claims, 10 Drawing Sheets

HEAT EXCHANGER

CROSS REFERENCE TO RELATED APPLICATIONS

This application claims benefit of priority under 35 U.S.C § 119 to Japanese Patent Application No. 2003-35689, filed on Feb. 13, 2003, the entire contents of which are incorporated by reference herein.

BACKGROUND OF THE INVENTION

1. Field of the Invention

The present invention relates to a heat exchanger for use in an air conditioning unit of an automobile for cooling or warming a compartment of the automobile.

2. Description of the Related Art

A heat exchanger of the related art is disclosed in Japanese Patent Provisional Publication No. 10-170175. As shown in FIGS. 1 and 2, the heat exchanger 6 is comprised of a first intake port 9, a first outlet port 10, a sub-condenser 11, a second intake port 12, a second outlet port 13, a case 14, header pipes 15*a*, 15*b*, heat transfer tubes 16 and fins 17.

The first intake port 9 admits first coolant to flow into the heat exchanger 6 from a condenser. The first outlet port 10 admits first coolant to flow into an evaporator from the heat exchanger 6. First ends of the header pipes 15*a*, 15*b* are connected to the first intake port 9 and the first outlet port 10, respectively. The header pipes 15*a*, 15*b* extend along a longitudinal direction of the heat exchanger 6 in mutually spaced relationship. The plural heat transfer tubes 16 are connected to second ends of the header pipes 15*a*, 15*b*. The heat transfer tubes 16 extend along the longitudinal direction of the heat exchanger 16 in mutually spaced relationship. The plural fins 17 are disposed between the adjacent heat transfer tubes 16, 16. The sub-condenser 11 includes the header pipes 15*a*, 15*b*, the heat transfer tubes 16 and the fins 17. The second intake port 12 admits second coolant to flow into the heat exchanger 6 from the evaporator. Second coolant is created upon evaporation of first coolant. The second outlet port 13 admits second coolant to flow into a compressor from the heat exchanger 6. The case 14 is coupled to the second intake port 12 and the second outlet port 13 to seal peripheries of the sub-condenser 11 in airtight and liquid-tight relationship.

First coolant (as indicated by an arrow A in the figure) delivered from the first intake port 9 into the sub-condenser 11 undergoes heat-exchange with second coolant (as indicated by an arrow B in the figure) delivered from the second intake port 12 into the case 14. During such heat-exchange, first coolant is cooled with second coolant.

The heat exchanger of the related art has problems described below.

Due to the presence of second coolant flowing through the case 14 in direct contact with outer peripheries of the heat transfer tubes 16 through which first coolant flow, when using fluid, such as water, generating external corrosion as second coolant, the heat transfer tubes 16 suffer from corrosions caused by second coolant.

If corrosions occur on the heat transfer tubes 16, second coolant is mixed with first coolant in the case 14. Therefore, between first and second coolants, pressure of either one of coolants is imparted to the other coolant. This leads the heat exchanger 6 to be damaged.

Also, since the heat transfer tubes 16 are accommodated in the case 14, it is hard to find corroded states of the heat transfer tubes.

SUMMARY OF THE INVENTION

It is therefore an object of the present invention to provide a heat exchanger that is effective for tubes, through which coolant flows, to be protected from corrosions.

To achieve the above object, the present invention provides a heat exchanger for exchanging heat between first and second coolants, comprising a first tube formed with a first flow passage through which the first coolant flows, a second tube formed with a second flow passage through which the second coolant flows, a first inlet-connecting block connected to a first end of the first tube and having a first flow inlet communicating with the first flow passage, a first outlet-connecting block connected to a second end of the first tube and having a first flow outlet communicating with the first flow passage, a second inlet-connecting block connected to a first end of the second tube and having a second flow inlet communicating with the second flow passage, and a second outlet-connecting block connected to a second of the second tube and having a second flow outlet communicating with the second flow passage, wherein the first and second tubes are disposed such that the first and second flow passages are substantially perpendicular to one another.

According to the present invention, since the first and second tubes are disposed to be independent from one another, heat-exchange generates between first and second coolants through the first and second tubes. Therefore, no direct contact occurs between first coolant (or second coolant) and an outer periphery of the tube through which second coolant (or first coolant) flows, enabling the tube to be protected from corrosion while maintaining strength of the tube.

Further, according to the present invention, since the first and second tubes are disposed such that the first and second flow passages are substantially perpendicular to one another, is greatly improved configuration freedoms in the first inlet-connecting block, the second inlet-connecting block, the first outlet-connecting block and the second outlet-connecting block. Also, with such a structure, since the first and second tubes can have increased contact surface areas, heat-exchange performance is improved greatly.

DESCRIPTION OF THE PREFERRED EMBODIMENTS

Reference will now be made to various embodiments of heat exchangers according to the present invention with reference to FIGS. 3 to 9 of the accompanying drawings. Directional terms, such as X-axis, Y-axis and Z-axis are set in a longitudinal direction, a lateral direction and a vertical direction of the heat exchanger, respectively, in the accompanying drawings. Also, the X-axis, the Y-axis and the Z-axis are perpendicular to one another.

First Embodiment

Figure 1:
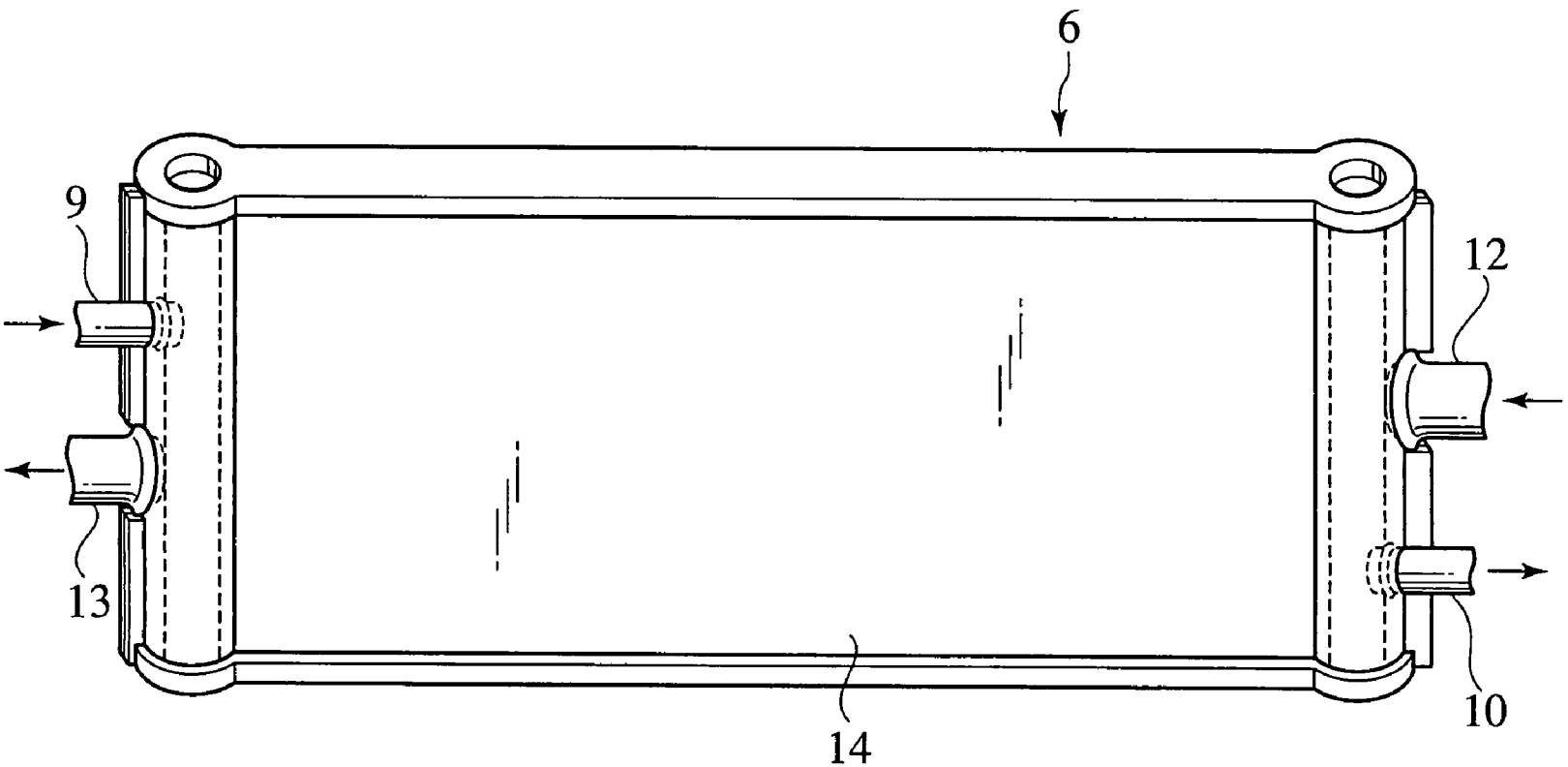
FIG.1 PRIOR ART
FIG. 1 is a perspective view of a heat exchanger of the related art.
Figure 2:
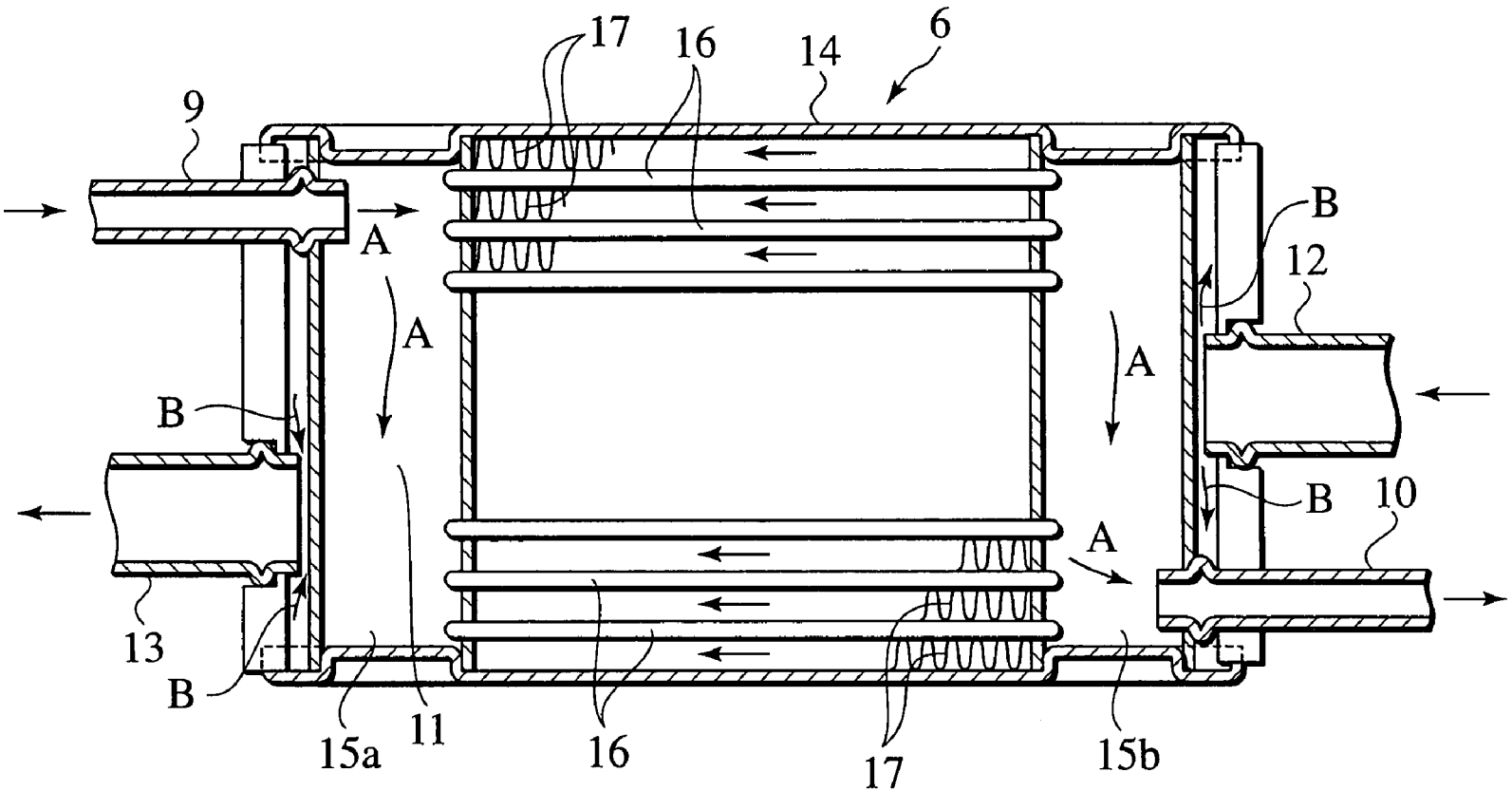
FIG.2 PRIOR ART
FIG. 2 is a cross sectional view of the heat exchanger of the related art.
Figure 3:
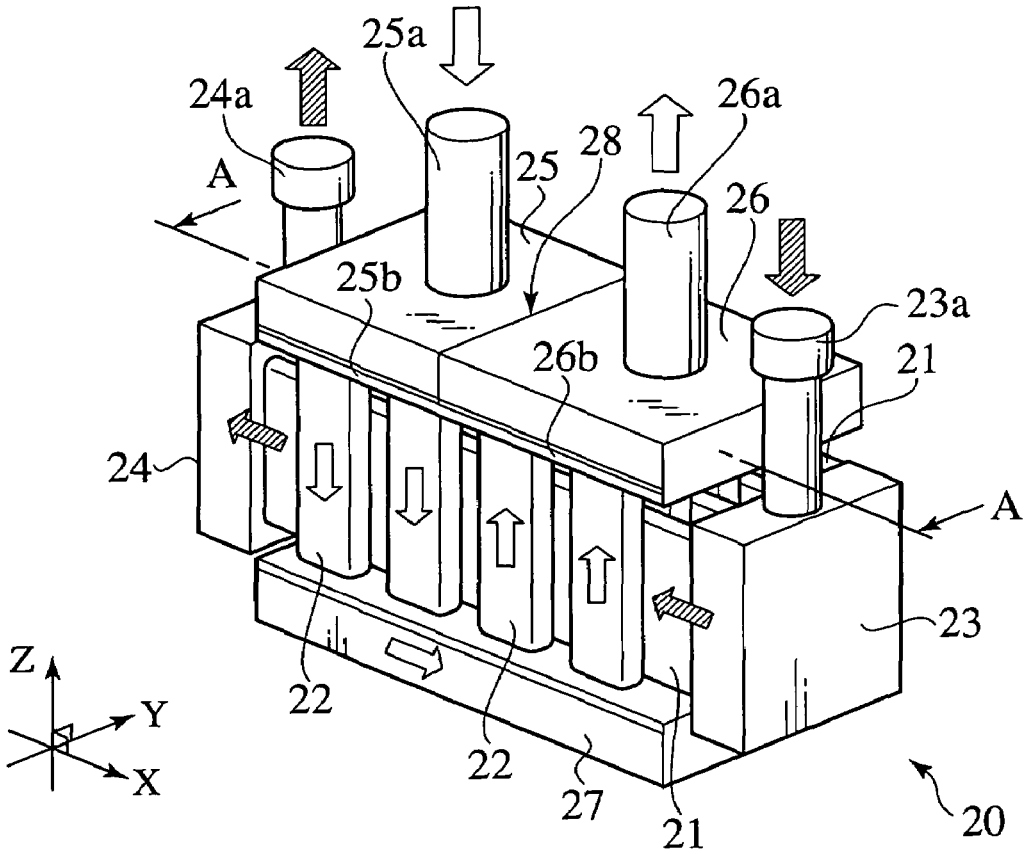
FIG. 3 is a perspective view of a heat exchanger of a first embodiment of the present invention.

As shown in FIG. 3, a heat exchanger 20 is comprised of first tubes 21, second tubes 22, a first inlet-connecting block 23, a first outlet-connecting block 24, a second inlet-connecting block 25, a second outlet-connecting block 26, a terminal connecting block 27, and a partition wall 28.

The plural first tubes 21 extend along the longitudinal direction (along the X-axis) of the heat exchanger 20 in parallel with respect to one another. The first tubes 21 internally have first flow passages 21*a*, respectively, through which first coolant flows. Also, first coolant includes gas coolant or the like prevailing at a high temperature under high pressure. The plural second tubes 22 extend along the vertical direction (along the Z-axis) of the heat exchanger 20 in parallel with respect to one another. The second tubes 22 internally have second flow passages 22*a*, respectively, through which second coolant flows. Also, second coolant includes hot water or the like. The second tubes 22 are classified into an inflow tube group and an outflow tube group.

The first inlet-connecting block 23 is coupled to first ends (on +X side) of the first tubes 21. The first inlet-connecting block 23 has a first flow inlet 23*a* that communicates with the first flow passages 21*a*. The first outlet-connecting block 24 is coupled to second ends (on −X side) of the first tubes 21. The first outlet-connecting block 24 has a first flow outlet 24*a* that communicates with the first flow passages 21*a*.

The second inlet-connecting block 25 is coupled to first ends (on +Z side) of the second tubes 22 that belong to the inflow tube group. The second inlet-connecting block 25 has a second flow inlet 25*a* that communicates with the second flow passages 22*a*. The second outlet-connecting block 26 is coupled to first ends (on +Z side) of the second tubes 22 that belong to the outflow tube group. The second outlet-connecting block 26 has a second flow outlet 26*a* that communicates with the second flow passages 22*a*. The terminal connecting block 27 is connected to second ends (on −Z side) of the second tubes 22 that belong to the inflow and outflow tube groups. The partition wall 28 is integrally formed with the second inlet-connecting block 25 and the second outlet-connecting block 26, thereby partitioning the second inlet-connecting block 25 and the second outlet-connecting block 26.

Figure 4:
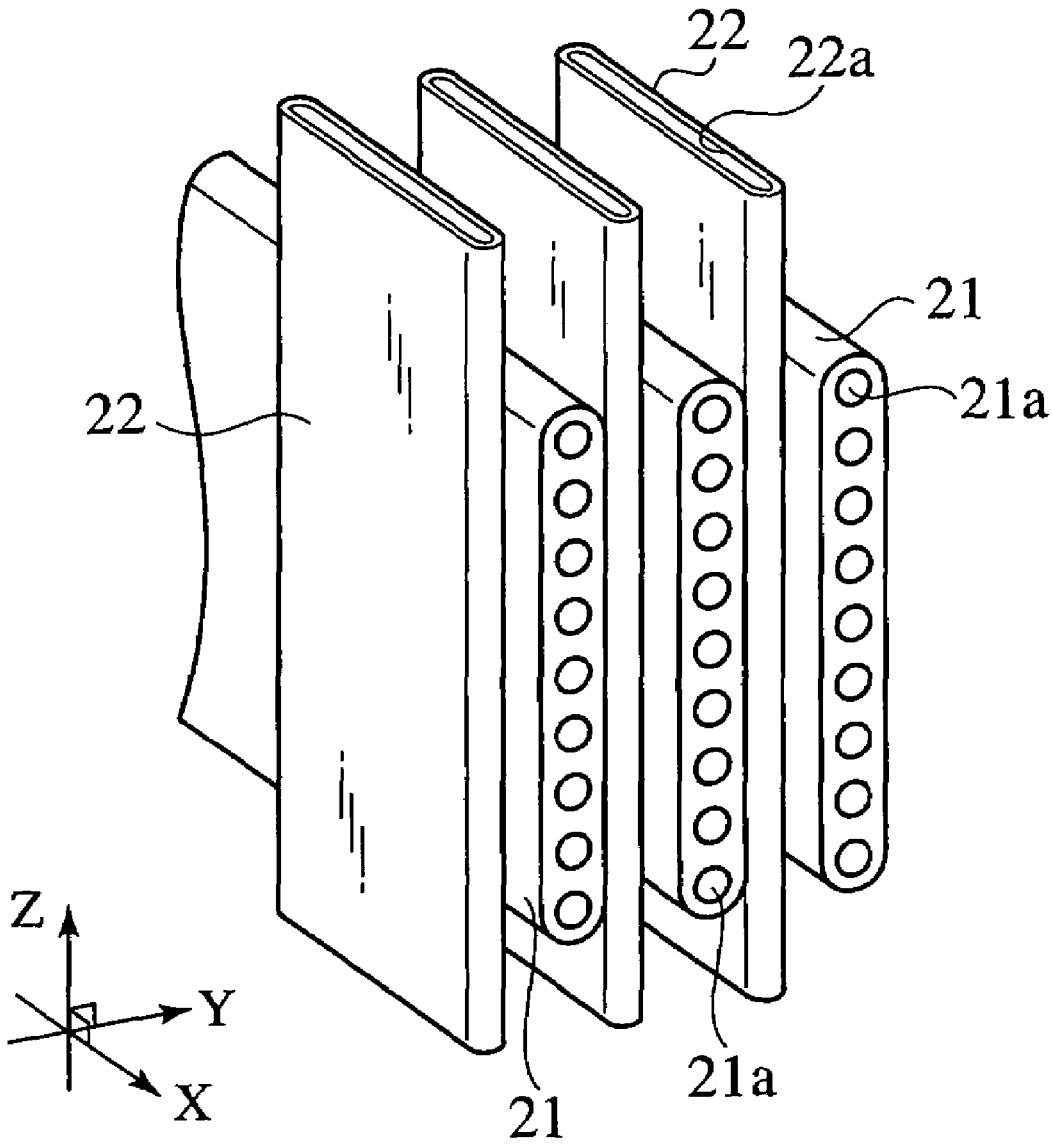
FIG. 4 is an enlarged view of an essential part of the heat exchanger of the first embodiment of the present invention.
Figure 5:
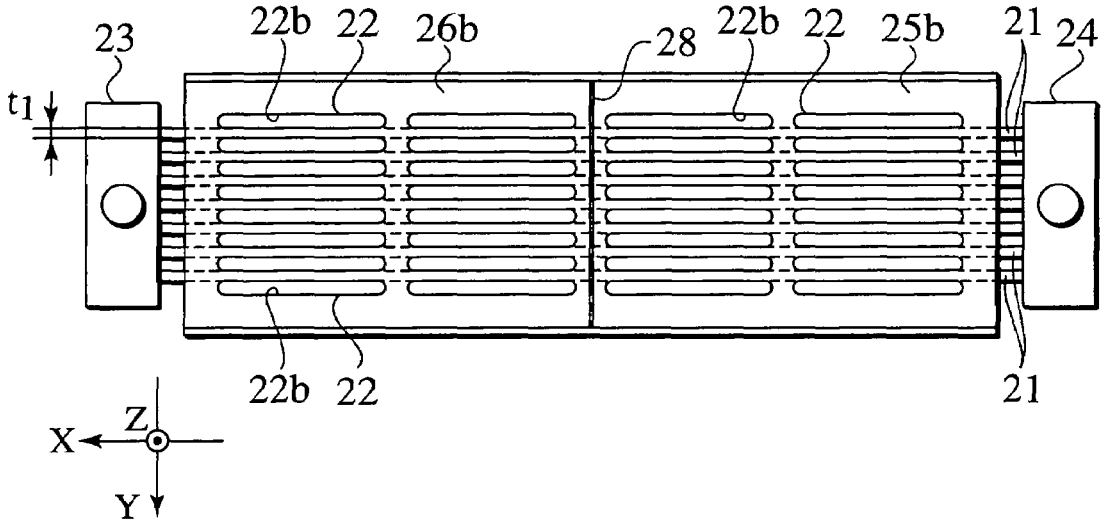
FIG. 5 is a cross sectional representation, taken on line A-A of FIG. 3, of the heat exchanger of the first embodiment of the present invention.

As shown in FIGS. 4 and 5, the first and second tubes 21 and 22 are alternately disposed in the heat exchanger 20 along the lateral direction (in the Y-axis). The first tube 21 is fixedly sandwiched between the adjacent second tubes 22, 22 by suitable technique such as brazing.

Disposed on a lower end of the second inlet-connecting block 25 is a seat plate 25*b*. Likewise, disposed on a lower end of the second outlet-connecting block 26 is a seat plate 26*b*. The seat plate 25*b* has connecting apertures 22*b* through which the second tubes 22 are connected to the second inlet-connecting block 25. The seat plate 26*b* has connecting apertures 22*b* through which the second tubes 22 are connected to the second outlet-connecting block 26. In the lateral direction of the heat exchanger 20, the adjacent second tubes 22, 22 are placed with a pitch t1. Also, the pitch t1 equals a thickness of each first tube 21 in the lateral direction thereof.

In the presently filed embodiment, seven pieces of first tubes 21 are located in the lateral direction (along the Y-axis) of the heat exchanger 20. Eight pieces of the second tubes 22 are disposed in the lateral direction (along the Y-axis) of the heat exchanger 20 and in four sets in the longitudinal direction (along the X-axis) of the heat exchanger 20.

The heat exchanger 20 admits first coolant to flow into the first inlet-connecting block 23 from the first flow inlet 23*a*. Then, first coolant is diversified into the first flow passages 21*a* of the plural first tubes 21. Thereafter, first coolant moves inside of the first flow inlet 21*a* and flows into the first outlet-connecting block 24. The streams of first coolant join at the first outlet-connecting block 24 again and first coolant flows out from the first flow outlet 24*a*.

Further, the heat exchanger 20 admits second coolant to flow into the second inlet-connecting block 25 from the second flow inlet 25*a*. Then, second coolant is diversified into the second flow passages 22*a* of the plural second tubes 22. Second coolant moves into the second flow passages 22*a* and flows into the terminal connecting block 27. Thereafter, second coolant flows from the terminal connecting block 27 into the second flow passages 22*a* of the second tubes 22 that communicate with the second outlet-connecting block 26. Depending upon a series of such flows, second coolant flows from the second inlet-connecting block 25 into the second outlet-connecting block 26 and flows out of the heat exchanger 20 from the second flow outlet 26*a*.

By the use of the heat exchanger 20 as a heat exchanger of an automobile air conditioning unit, advantageous effects result in as described below.

Since, in the heat exchanger 20, first and second coolants held in contact with one another via the first and second tubes 21, 22, the heat exchanger 20 enables the tubes to be protected from corrosions and maintains strengths of the tubes.

A layout in which the first and second tubes 21, 22 are disposed so as to allow the first and second flow passages 21*a*, 22*a* to be substantially perpendicular to one another, are improved configuration freedoms of the first inlet-connecting block 23, the second inlet-connecting block 25, the first outlet-connecting block 25, the first outlet-connecting block 26 and the terminal connecting block 27. Also, with such a structure, contact surface area between the first and second tubes 21, 22 can be expanded. Therefore, hot water fed to a heater of the automobile air conditioning unit can be efficiently warmed up, providing improved heat-exchange efficiency.

When installing the heat exchanger 20 as an air conditioning unit of a fuel cell powered vehicle, the use of hot water stocked in a FC (Fuel Cell) provides an improved warming up efficiency of hot water.

Second Embodiment

Figure 6:
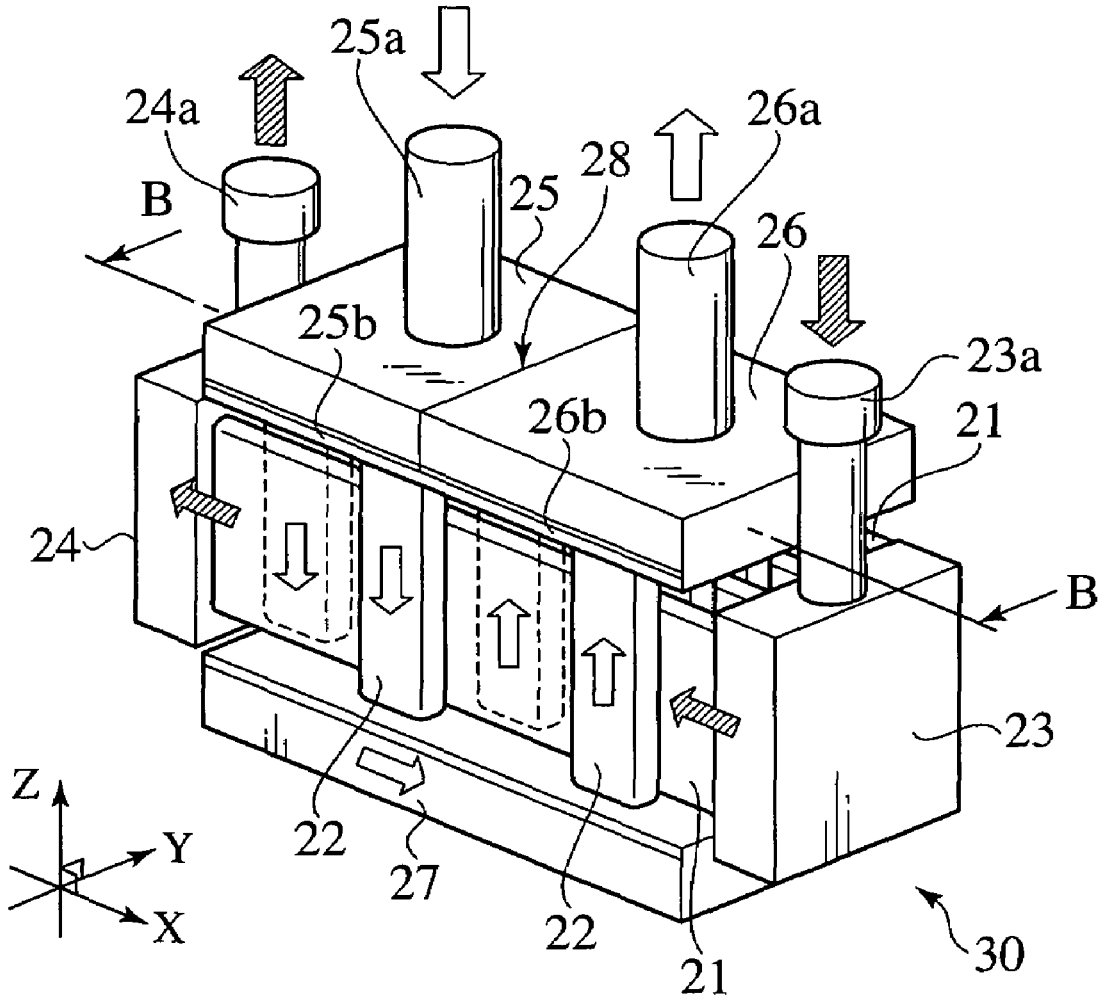
FIG. 6 is a perspective view of a heat exchanger of a second embodiment of the present invention.
Figure 7:
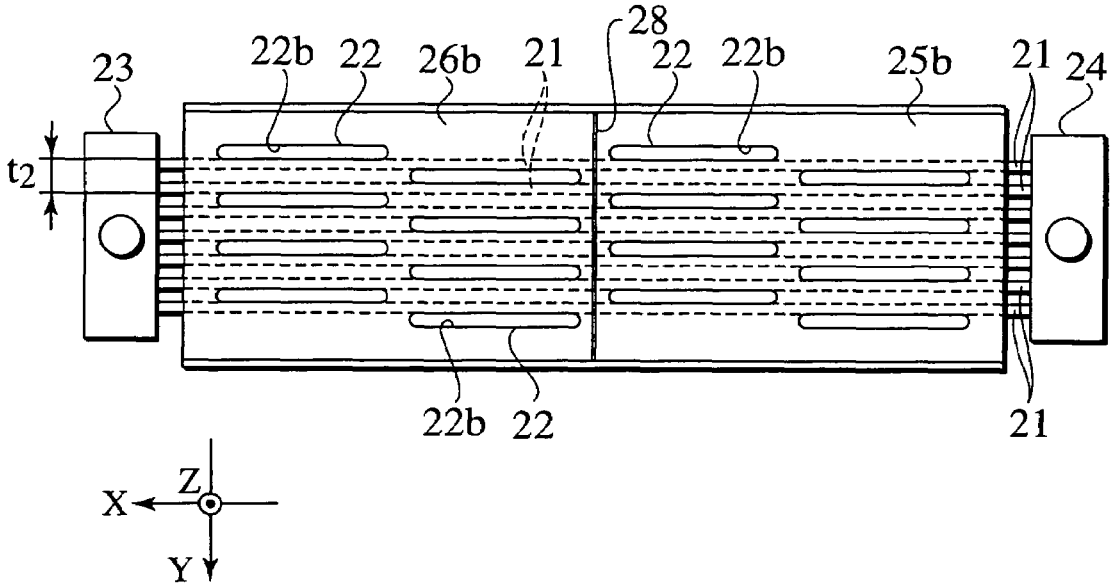
FIG. 7 is a cross sectional representation, taken on line B-B of FIG. 6, of the heat exchanger of the second embodiment of the present invention.

A heat exchanger 30 differs from the heat exchanger 20 in which the seat plates 25*b*, 26*b* have connecting apertures 22*b* that are formed in a zigzag arrangement along the lateral direction (along Y-axis) of the heat exchanger 30 (see FIGS. 6 and 7). In the presently filed embodiment, description of the same component parts as those of the first embodiment is omitted.

In the lateral direction of the heat exchanger 30, the adjacent second tubes 22, 22 are disposed with a pitch t2. The pitch t2 is approximately three times the pitch t1 of the first embodiment as shown in FIG. 7.

By the use of the heat exchanger 30 as the heat exchanger of the automobile air conditioning unit, advantageous effects can be obtained in addition to the advantageous effects of the first embodiment.

Due to a layout in which the connecting apertures 22*b* are disposed in the zigzag arrangement along the lateral direction (along Y-axis) of the heat exchanger 30, the pitch between the adjacent second tubes 22, 22 becomes larger than the pitch of the first embodiment. Accordingly, it becomes easy to perform work for forming the connecting apertures 22*b* in the seat plates 25*b*, 26*b*. Further, are improved strengths of the seat plates 25*b*, 26*b* around connecting apertures 22*b*.

Third Embodiment

Figure 8:
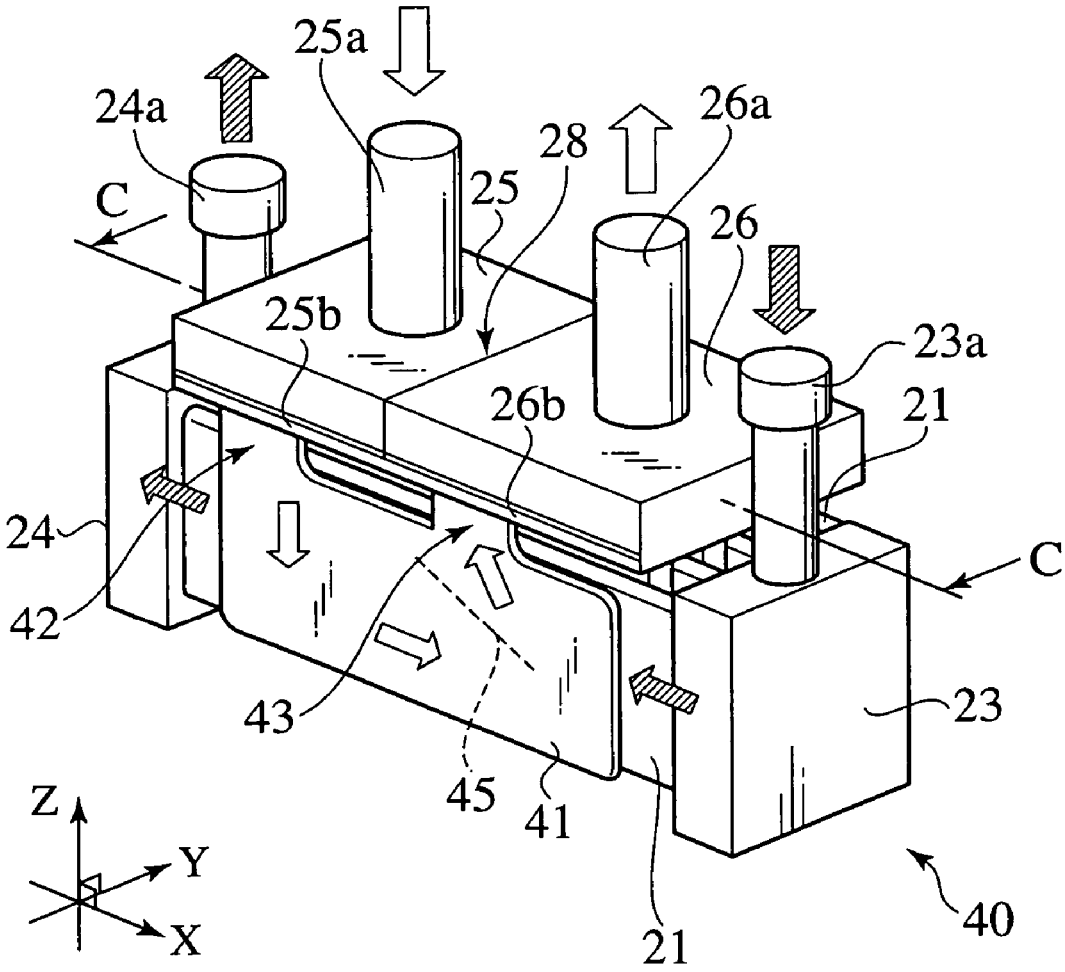
FIG. 8 is a perspective view of a heat exchanger of a third embodiment of the present invention.

A heat exchanger 40 differs from the heat exchanger 20 in which second flow passages 41*a* of second tubes 41 are formed in a substantially U-shaped configuration and in which the terminal connecting block 27 is dispensed with (see FIGS. 8 and 9). In the presently filed embodiment, description of the same component parts as those of the first embodiment is omitted.

Figure 9A:
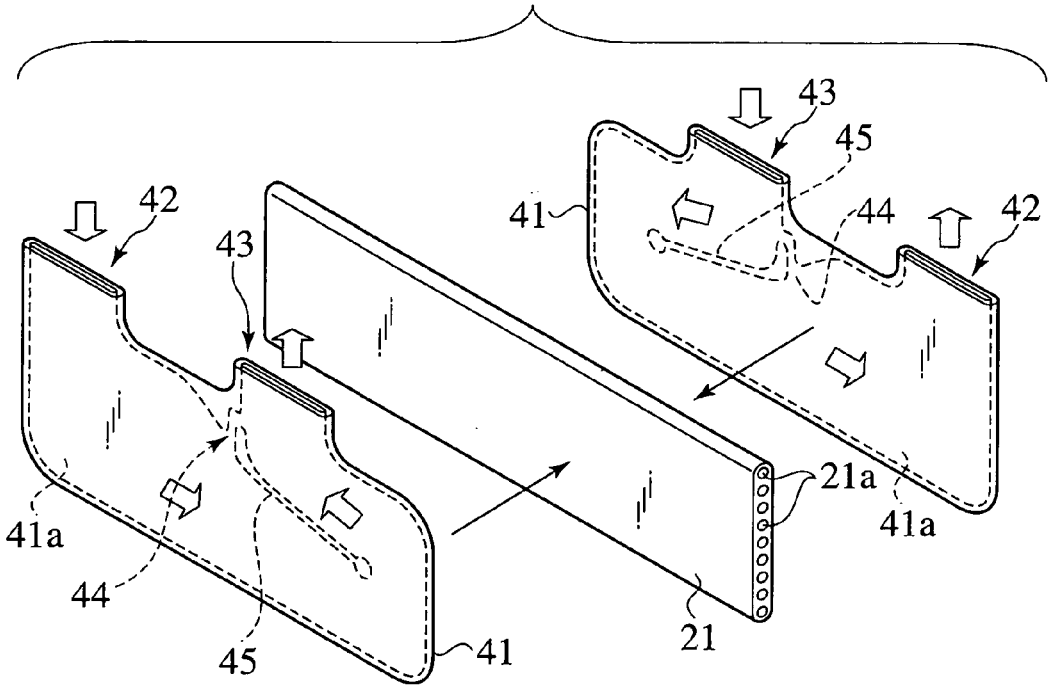
FIG. 9A is an enlarged view of an essential part of the heat exchanger of the third embodiment of the present invention.

As shown in FIG. 9A, the second flow passage 41*a* is formed in a substantially U-shaped configuration in the second tube 41. The second tube 41 has a first opening portion 42 to be coupled to the seat plate 25*b*, and a second opening portion 43 to be connected to the seat plate 26*b*. The first opening portion 42 is formed on one end of the second tube 41. The second opening portion 43 is formed at a position closer to a central area by a given distance from the other end of the second tube 41. The first and second opening portions 42, 43 are separate from one another by a given distance in the longitudinal direction of the second tube 41. Also, the first opening portion 42 may be connected to the seat plate 26*b*, and the second opening portion 43 may be connected to the seat plate 25*b*.

Figure 9B:
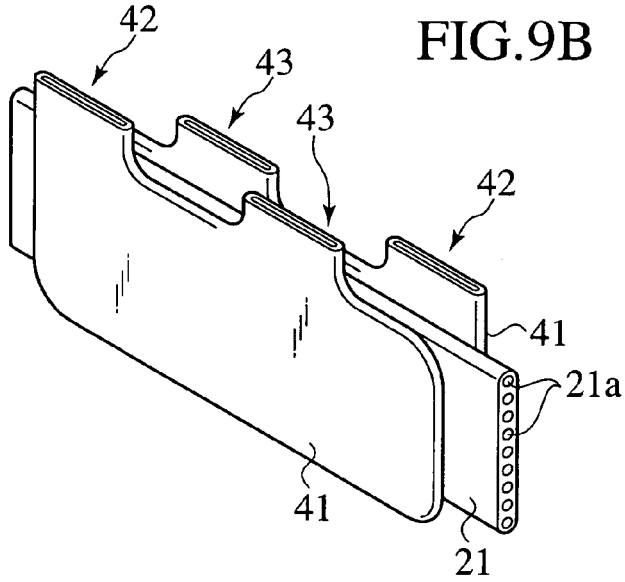
FIG. 9B is an enlarged view of the essential part of the heat exchanger of the third embodiment of the present invention.

The above described given distance is determined in a manner described below. As shown in FIG. 9B, the first and second opening portions 42, 43 are separate from one another such that when placing the second tubes 41, 41 in a point symmetry and aligning the ends of the second tubes 41, 41 so as to sandwich the first tube 21, the first and second opening portions 42, 43 do not overlap with respect to one another as viewed from −Y side.

Formed inside of the second flow passage 41*a* of the second tube 41 is an air bleed portion 44 for discharging air, accompanied by flow of second coolant, to the outside of the second tube 41. Further, formed inside of the second flow passage 41*a* of the second tube 41 is a flow path partitioning portion 45 that extends from the lower part of the air bleed portion 44 toward the other end in substantially parallel to the longitudinal direction of the second tube 41. The flow path partitioning portion 45 is formed so as to prevent a drift (a flow with unbalanced flow rate distribution) of the second coolant inside the second flow passage 41*a* based on the testing of flow rate distribution. Even in a case where the first opening portion 42 is connected to the seat plate 26*b* and the second opening portion 43 is connected to the seat plate 25*b*, second coolant smoothly flows from the second inlet-connecting block 25 to the second outlet-connecting block 26 due to the presence of the flow path partitioning portion 45.

Figure 10:
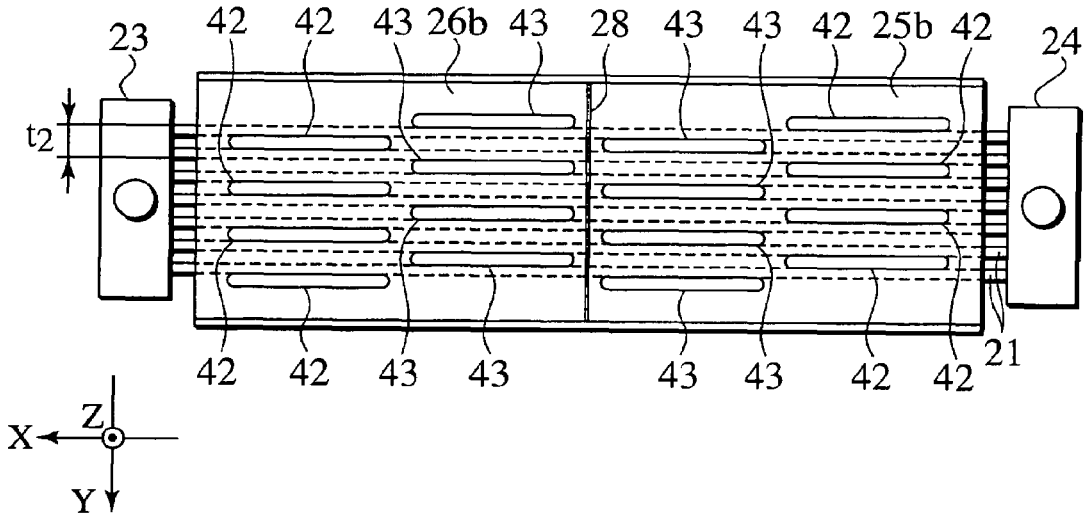
FIG. 10 is a cross sectional representation, taken on line C-C of FIG. 8, of the heat exchanger of the third embodiment of the present invention.

As shown in FIG. 10, eight pieces of second tubes 41 are disposed in the lateral direction of the heat exchanger 40 in a single unit along the longitudinal direction of the heat exchanger 40. The adjacent second tubes 41, 41 are disposed in point symmetry. The eight pieces of second tubes 41 disposed in the lateral direction of the heat exchanger 40 are termed, in a sequence from −Y side, a first tube, a second tube, a third tube, a fourth tube, a fifth tube, a sixth tube, a seventh tube and an eighth tube. Communicating with the second inlet-connecting block 25 are first opening portions 42 of the first, third, fifth and seventh tubes, and the second opening portions 43 of the second, fourth, sixth and eighth tubes. Communicating with the second outlet-connecting block 26 are second opening portions 43 of the first, third, fifth and seventh tubes, and the first opening portions 42 of the second, fourth, sixth and eighth tubes.

In the lateral direction of the heat exchanger 40, the adjacent second tubes 22, 22 are disposed with a pitch t2. As shown in FIG. 10, the pitch t2 is approximately three times the pitch t1 of the first embodiment.

By the use of the heat exchanger 40 as the heat exchanger of the automobile air conditioning unit, advantageous effects can be obtained in addition to the advantageous effects of the first and second embodiments.

Since the second flow passage 41*a* is formed in the substantially U-shaped configuration in the second tube 41, it becomes possible for the terminal connecting block 27 to be dispensed with, realizing miniaturization of the heat exchanger.

Since the air bleed portion 44 is formed inside of the second flow passage 41*a*, second coolant smoothly flows through the second flow passage 41*a*.

Due to the presence of the flow path partitioning portion 45 formed inside of the second flow passage 41*a*, even when the second tubes 41, 41 are disposed in the point symmetry and connected to the seat plates 25*b*, 26*b*, second coolant smoothly flows through the second flow passages 41*a* from the second inlet-connecting block 25 to the second outlet-connecting block 26.

Other Embodiment

The present invention is not limited to the heat exchangers 20, 30, 40, and a variety of embodiments may be adopted within a range without departing from the spirit and scope of the present invention.

For instance, in the first embodiment, seven pieces of first tubes 21 may be disposed in the lateral direction of the heat exchanger, and eight pieces of second tubes 22 may be disposed in the lateral direction of the heat exchanger 20 and in four sets in the longitudinal direction of the heat exchanger 20. However, the present invention is not limited to such examples, and plural first tubes 21 and plural second tubes 22 may be provided. Further, in the second and third embodiments, the pitch t2 is approximately three times the pitch t1 of the first embodiment. However, the present invention is not limited to such examples.

What is claimed is:

1. A heat exchanger for exchanging heat between first and second coolants, comprising:

a first tube formed with a first flow passage through which the first coolant flows;

a plurality of second tubes, each formed with a second flow passage through which the second coolant flows, wherein the first tube is sandwiched between a first adjacent second tube and a second adjacent second tube;

a first inlet-connecting block connected to a first end of the first tube and having a first flow inlet communicating with the first flow passage;

a first outlet-connecting block connected to a second end of the first tube and having a first flow outlet communicating with the first flow passage;

a second inlet-connecting block connected to a first end of each of the second tubes and having a second flow inlet communicating with the second flow passage; and a second outlet-connecting block connected to a second end of each of the second tubes and having a second flow outlet communicating with the second flow passage;

wherein the first tube and the second tubes are disposed such that the first and second flow passages are substantially perpendicular to one another, the first tube includes a plurality of pieces of tubes, the pieces of the first tube are disposed in parallel to one another along a longitudinal direction of the heat exchanger, and the second tubes are disposed in parallel to one another along a vertical direction of the heat exchanger, and the second tubes include an inflow tube group and an outflow tube group, and tubes that belong to the inflow tube group have first ends connected to the second inlet-connecting block and second ends connected to a terminal connecting block while tubes that belong to the outflow tube group have first ends connected to the terminal connecting block and second ends connected to the second outlet-connecting block.

2. A heat exchanger for exchanging heat between first and second coolants, comprising:

a plurality of first tubes each formed with a first flow passage through which the first coolant flows;

a plurality of second tubes each formed with a second flow passage through which the second coolant flows;

a first inlet-connecting block connected to a first end of each first tube and having a first flow inlet communicating with each first flow passage;

a first outlet-connecting block connected to a second end of each first tube and having a first flow outlet communicating with each first flow passage;

a second inlet-connecting block connected to a first end of each second tube and having a second flow inlet communicating with each second flow passage; and a second outlet-connecting block connected to a second end of each second tube and having a second flow outlet communicating with each second flow passage;

wherein the first and second tubes are disposed such that the first and second flow passages are substantially perpendicular to one another, and the second tubes include an inflow tube group and an outflow tube group, and tubes that belong to the inflow tube group have first ends connected to the second inlet-connecting block and second ends connected to a terminal connecting block while tubes that belong to the outflow tube group have first ends connected to the terminal connecting block and second ends connected to the second outlet-connecting block.

* * * * *